US007254959B1

(12) United States Patent
Covert, Jr. et al.

(10) Patent No.: US 7,254,959 B1
(45) Date of Patent: Aug. 14, 2007

(54) JOULE-THOMSON EFFECT AIR CONDITIONER USING AIR AS THE REFRIGERANT

(75) Inventors: Gerald L. Covert, Jr., Virgina Beach, VA (US); Leon R. Goolsby, Jr., Hampton, VA (US)

(73) Assignee: Cogo Aire LLC, Newport News, VA (US)

( * ) Notice: Subject to any disclaimer, the term of this patent is extended or adjusted under 35 U.S.C. 154(b) by 2 days.

(21) Appl. No.: 11/406,555

(22) Filed: Apr. 19, 2006

(51) Int. Cl.
*F25D 9/00* (2006.01)

(52) U.S. Cl. ..... 62/401; 62/51.2

(58) Field of Classification Search ..... 62/51.1, 62/51.2, 401, 507
See application file for complete search history.

(56) References Cited

U.S. PATENT DOCUMENTS

| | | | | |
|---|---|---|---|---|
| 3,698,182 | A * | 10/1972 | Knoos | 60/522 |
| 5,024,060 | A * | 6/1991 | Trusch | 62/51.2 |
| 5,590,538 | A * | 1/1997 | Hsu et al. | 62/51.2 |
| 6,530,234 | B1 * | 3/2003 | Dobak et al. | 62/52.1 |
| 2005/0245943 | A1 * | 11/2005 | Zvuloni et al. | 606/121 |

* cited by examiner

*Primary Examiner*—Melvin Jones
(74) *Attorney, Agent, or Firm*—Peter J. Van Bergen

(57) ABSTRACT

An air conditioning system has a compressor for generating compressed air that is delivered to Joule-Thomson orifice with the compressed air flowing therethrough becoming refrigerant air sent through a heat exchanger. The heat exchanger is defined by triangular tubes arranged in a spaced-apart relationship to define flow paths therebetween so that ambient air moving through the flow paths of the heat exchanger is cooled.

24 Claims, 4 Drawing Sheets

JOULE-THOMSON EFFECT AIR CONDITIONER USING AIR AS THE REFRIGERANT

FIELD OF THE INVENTION

The invention relates generally to air conditioning systems, and more specifically to an air conditioning system that provides for efficient cooling while using air as the system's refrigerant.

BACKGROUND OF THE INVENTION

Conventional vapor-compression air conditioning systems use a working fluid such as chlorofluorocarbons (CFCs), e.g., FREON. A liquid CFC is typically introduced into a low-pressure heat exchanger where it absorbs heat at a low temperature and vaporizes. A compressor re-pressurizes the vapors that are then introduced to a high-pressure heat exchanger where heat is rejected to the environment and the vapors condense. The condensate is reintroduced into the low-pressure heat exchanger to complete the cycle.

The use of CFCs raises two important environmental concerns. First, CFCs are stable until they reach the stratosphere where they decompose into chlorine free radicals that catalyze the destruction of ozone. Second, CFCs absorption of infrared radiation contributes to global warming. Therefore, CFCs cannot be released into the environment and must be contained within the air conditioning system. Unfortunately, leaks are not uncommon in air conditioning systems. With the prevalence of CFC-based air conditioning systems in our world, there is a great need to provide non-CFC-based air conditioning systems.

The use of low pressure air in place of CFCs as the air conditioning working fluid has been considered. However, proposed systems have heat problems within the expansion area and frosting problems in the suction area. In some arid regions of the United States, an air-based air conditioner known as a "swamp cooler" has been used with some success. However, its usefulness is limited to very dry climates. Further, the cooled air produced by a swamp cooler is very humid thereby making the cooled air feel "clammy".

SUMMARY OF THE INVENTION

Accordingly, it is an object of the present invention to provide a non-CFC-based air conditioning system.

Another object of the present invention is to provide an air-based air conditioning system.

Still another object of the present invention is to provide an efficient air conditioning system that uses air as the working fluid.

Other objects and advantages of the present invention will become more obvious hereinafter in the specification and drawings.

In accordance with the present invention, an air conditioning system has a compressor for generating compressed air that is delivered to a plurality of Joule-Thomson orifices. The compressed air flows through selected ones of the Joule-Thomson orifices to thereby become refrigerant air sent through a heat exchanger. The heat exchanger is defined by triangular tubes arranged in a spaced-apart relationship to define flow paths therebetween so that ambient air moving through the flow paths of the heat exchanger is cooled.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
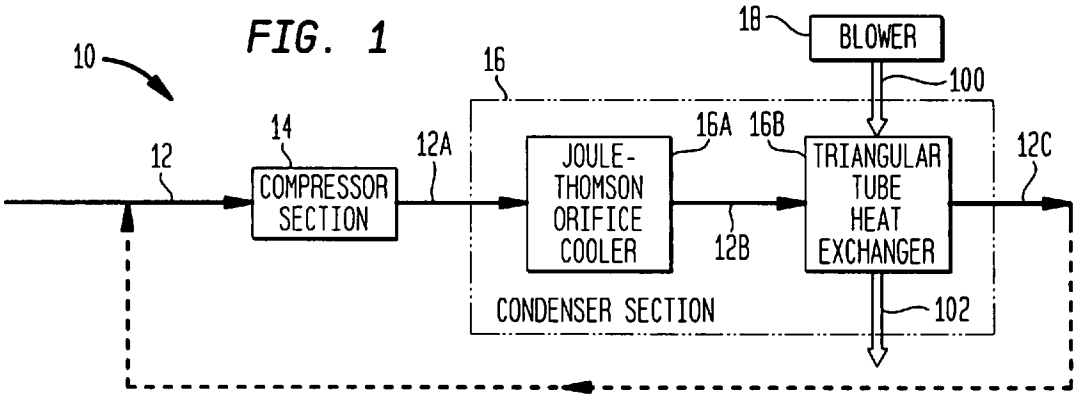
FIG. 1 is a block diagram of an air-based air conditioning system in accordance with the present invention.

Referring now to the drawings and more particularly to FIG. 1, an air-based air conditioning system in accordance with a basic embodiment of the present invention is shown and is referenced generally by numeral 10. As used herein, the term "air-based" refers to the working fluid or refrigerant used for system 10. Air conditioning system 10 can be adapted for use in a static structure or a vehicle without departing from the scope of the present invention.

Air conditioning system 10 compresses air referenced by arrow 12 at a compressor section 14 with the resulting compressed air 12A ultimately serving as the refrigerant for system 10. Compressed air 12A is provided to a unique condenser section 16 that chills compressed air 12A such that it can be used as the refrigerant for system 10. Briefly, compressed air 12A is supplied to a Joule-Thomson orifice cooler 16A that chills compressed air 12A to generate refrigerant air 12B. A novel triangular tube heat exchanger 16B receives refrigerant air 12B for efficient cooling of a flow of ambient air 100 passing over the tubes of heat exchanger 16B as will be explained further below. As a result of this energy transfer, cooled air 102 is exhausted from heat exchanger 16B. System 10 can (and typically will) include a blower 18 to generate and maintain the flow of ambient air 100 when system 10 is to generate cooled air 102.

Refrigerant air 12B passing through the tubes of heat exchanger 16B is exhausted as exhausted refrigerant air 12C.

For system efficiency, it may be desirable to use exhausted refrigerant air 12C as an additional or adjunct air supply (i.e., along with air 12) supplied to compressor section 14.

Figure 2:
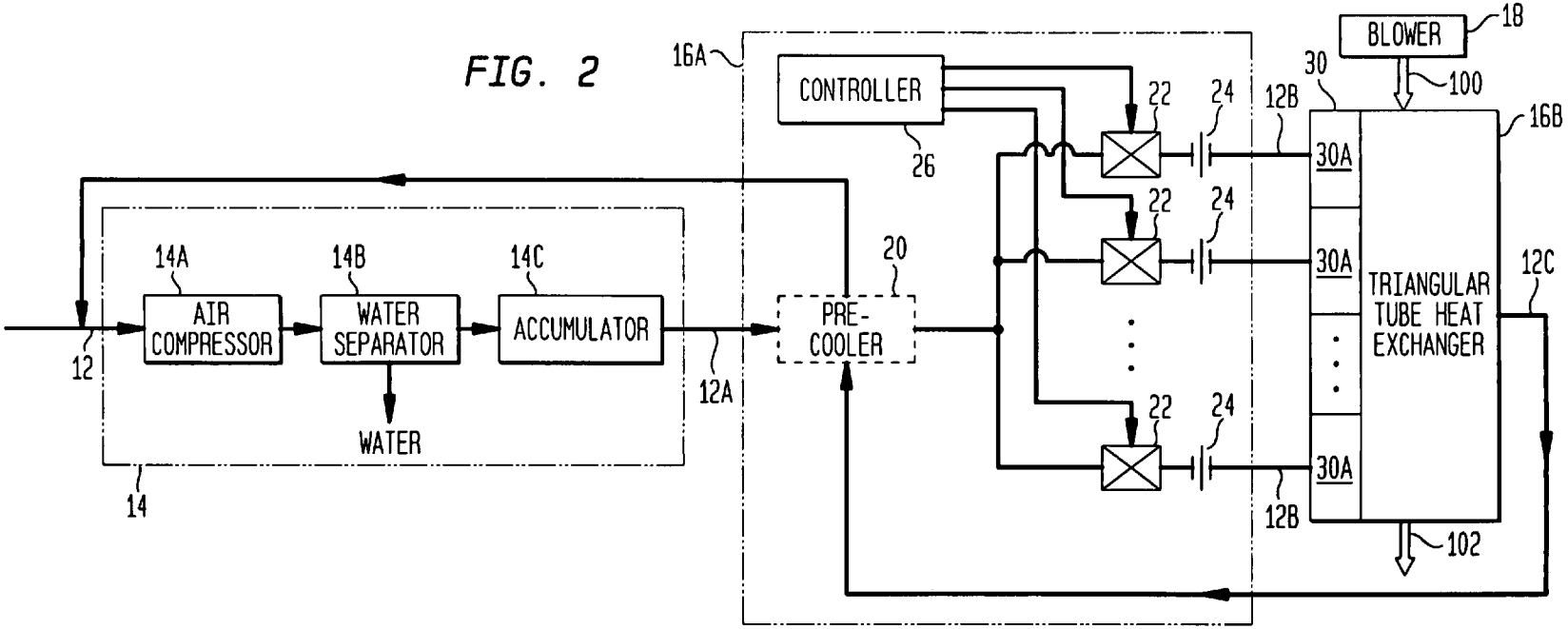
FIG. 2 is a schematic view of an air-based air conditioning system using a single-stage heat exchanger in accordance with an embodiment of the present invention.

Referring now to FIG. 2, a more detailed view of an embodiment of the present invention is illustrated utilizing a single-stage heat exchanger 16B. Compressor section 14 includes an air compressor 14A, a water separator 14B, and an accumulator 14C. Air compressor 14A is any conventional unit/system capable of generating the necessary compression of air 12. Water separator 14B is any device capable of removing water from the air compressed by air compressor 14A to thereby control the humidity of compressed air 12A. Accumulator 14C is a high pressure storage vessel used to store a supply of compressed air 12A at a specified pressure. Such accumulators are well known in the art of air compressor systems.

Joule-Thomson orifice cooler 16A is the means used to convert compressed air 12A to chilled refrigerant air 12B. Although not a requirement of the present invention, a pre-cooler 20 can be provided at the front end of cooler 16A to provide preliminary cooling of compressed air 12A. For example, pre-cooler 20 could be formed as a concentric jacket about the conduit (not shown) carrying compressed air 12A. The jacket would define an air space about the enclosed conduit and exhausted refrigerant air 12C could be passed through this air space before being supplied to air compressor 14A as an additional or adjunct air supply. The pre-cooled air is supplied to a bank or manifold of cooling lines with each cooling line being defined by a controllable valve 22 and a Joule-Thomson orifice 24. Each valve 22 can be coupled to a controller 26 that governs the opening/closing of each valve 22. Controller 26 could implement a pre-determined valve opening/closing plan, or could adaptively control valves 22 based on various temperature/pressure measurements made within the air conditioning system and in the ambient environment being cooled. Each Joule-Thomson orifice 24 is a flow restrictor that cools air passing therethrough via adiabatic expansion (i.e., the Joule-Thomson effect) as is known in the art. For best efficiency, orifices 24 should be located as close as possible to heat exchanger 16B.

For each valve 22 that is opened, refrigerant air 12B exits the associated Joule-Thomson orifice 24 and enters a header 30 forming the front end of heat exchanger 16B. Header 30 defines compartments 30A that are coupled to specified tubes (not shown) of heat exchanger 16B. In this way, selected tubes of heat exchanger 16B are supplied with refrigerant air 12B with all of the tubes of heat exchanger 16B receiving refrigerant air 12B when all of valves 22 are opened. Refrigerant air 12B then passes through heat exchanger 16B to cool ambient air 100 and thereby produce cooled air 102 as previously described.

The present invention can also be realized using multiple stages of the novel triangular tube heat exchanger.

Figure 3:
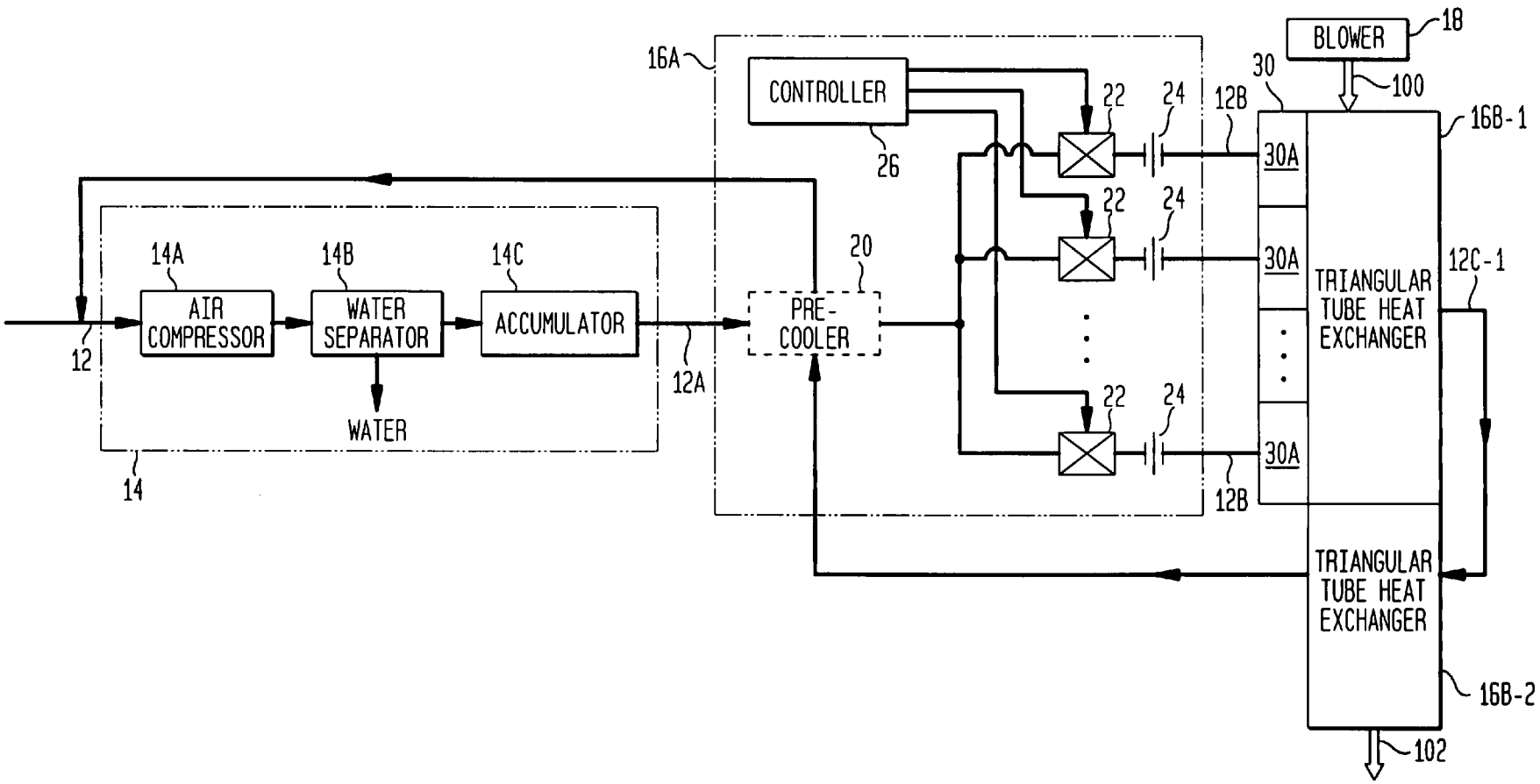
FIG. 3 is a schematic view of an air-based air conditioning system using a multi-stage heat exchanger in accordance with another embodiment of the present invention.

For example, another embodiment of the present invention is illustrated in FIG. 3 where two heat exchangers 16B are utilized. It is to be understood that additional heat exchanger stages could be used without departing from the scope of the present invention. The exhausted refrigerant air 12C-1 from the first heat exchanger 16B-1 is passed through the second heat exchanger 16B-2 while ambient air 100 is flowed sequentially through both heat exchanges prior to exiting as cooled air 102.

Figure 4:
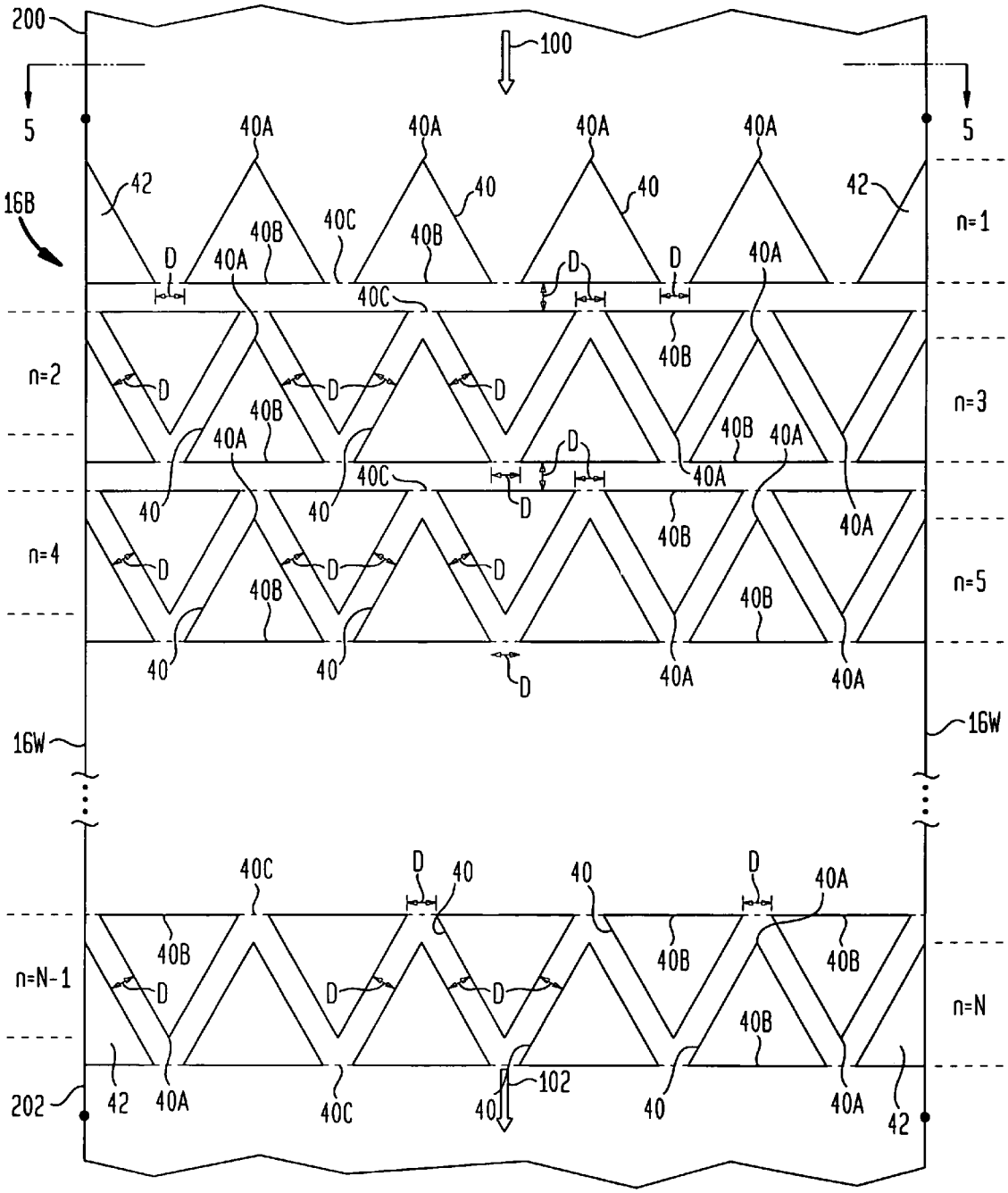
FIG. 4 is a cross-sectional schematic view of a triangular tube heat exchanger in accordance with an embodiment of the present invention.

Efficient heat transfer in the present invention is made possible by the configuration of triangular tube heat exchanger 16B. Referring now to FIG. 4, a cross-sectional schematic view of triangular tube heat exchanger 16B is shown with the side walls thereof indicated at 16W. Heat exchanger 16B is constructed with a number of individual and spaced-apart hollow tubes 40, each of which has a cross-sectional shape that is triangular. More specifically, the triangular shape can be that of an isosceles triangle (as shown) or an equilateral triangle. For simplicity, each of tubes 40 is identically sized. The number of tubes 40 is not a limitation of the present invention as the number illustrated in FIG. 4 is simply exemplary.

In operation, the refrigerant air (i.e., refrigerant air 12B described above) flows through some or all of tubes 40 as ambient air 100 is delivered to heat exchanger 16B via, for example, an air duct 200 having a flow area A where it couples to heat exchanger 16B. Ambient air 100 is typically under pressure (e.g., generated by blower 18 as illustrated in FIGS. 1-3) so that it will flow around tubes 40. The particular tubes 40 receiving the refrigerant air are determined by the opened ones of valves 22 (FIGS. 2 and 3) as described above.

Tubes 40 are arranged in parallel rows with the base 40B of each triangular tube 40 of a row being aligned along a baseline referenced by dashed line 40C. The apex 40A of each triangular tube 40 essentially points away from its baseline 40C in a direction that is perpendicular to baseline 40C. Spacing between adjacent tubes 40 along baseline 40C of each row and between any tube 40 and sidewall 16W is the same and is defined as "D".

For purposes of further description, the parallel rows of tubes 40 are indexed or numbered from n=1 to N with respect to the source of ambient air 100. That is, the first row (i.e., n=1) of tubes 40 is the row that is first contacted by ambient air 100 while the N-th row of tubes 40 is the last row of tubes 40 before the air flowing there past exits as cooled air 102 into, for example, an outlet duct 202. In general and as is evident from FIG. 4, the odd-numbered rows of tubes 40 have their associated apexes 40A facing or pointing towards the flow of ambient air 100 whereas the even-numbered rows of tubes 40 have their associated apexes 40A facing or pointing away from the flow of ambient air 100. The final N-th row can be an odd-numbered row with apexes 40A associated therewith pointing towards the flow of ambient air 100 as illustrated in FIG. 4. However, the present invention is not so limited as the final N-th row could also be an even-numbered row with apexes 40A associated therewith pointing away from the flow of ambient air 100.

Further, in rows n=2 through N, tubes 40 in adjacent rows interlock as shown with the spacing between the walls of adjacent tubes 40 set to the same spacing D. As a result, baselines 40C between adjacent odd and even-numbered rows oppose one another. In accordance with the illustrated embodiment, spacing between adjacent odd and even-numbered rows' baselines 40C is also set to D.

Figure 5:
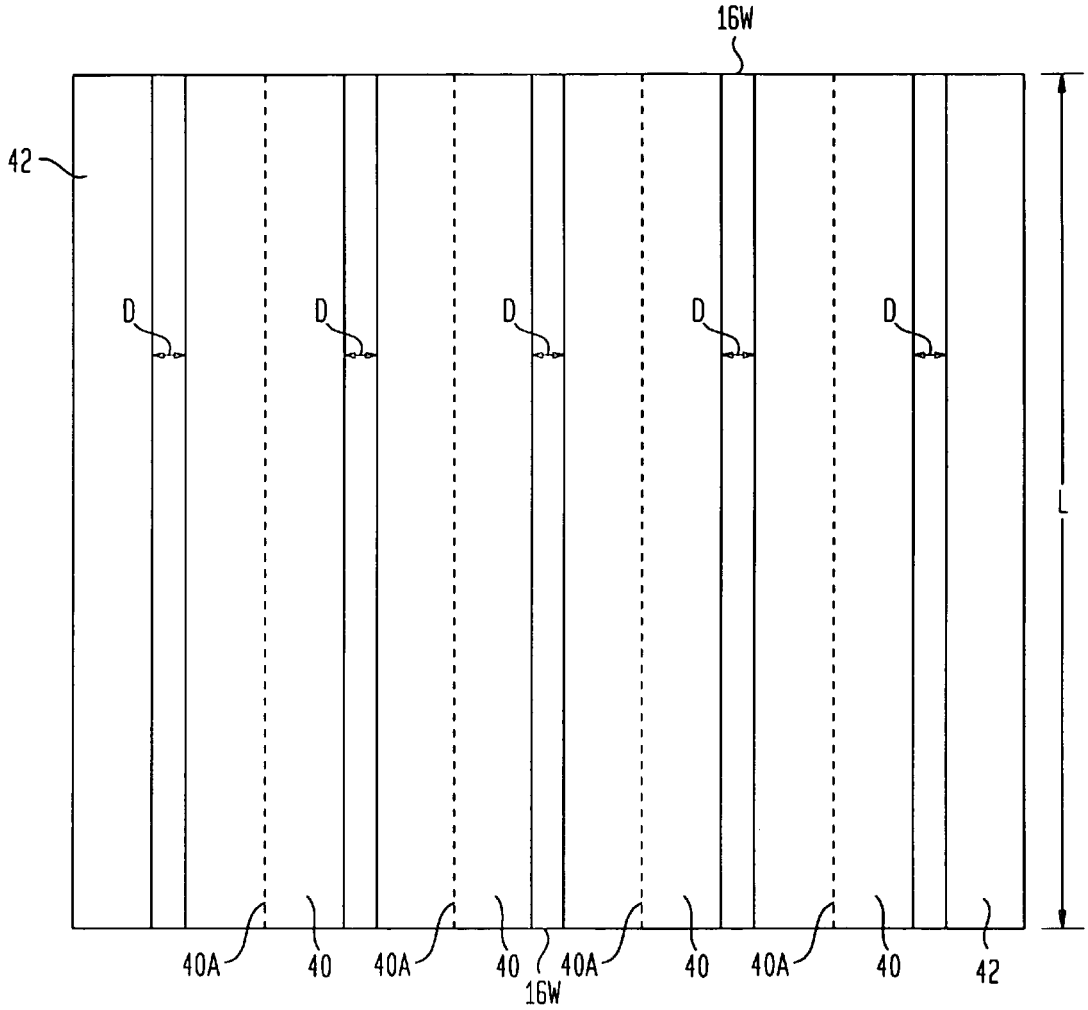
FIG. 5 is a head-on view of the heat exchanger taken along line 5-5 in FIG. 4.

As mentioned above, ambient air 100 typically enters heat exchanger 16B via a duct or other conduit (e.g., duct 200). The flow area provided for ambient air 100 entering heat exchanger 16B is defined as A. Flow area A is relevant to the spacing D as will now be explained with the aid of FIG. 5 which is a head-on view of the first row of tubes 40 (i.e., n=1) in heat exchanger 16B. The above-described spacing D between adjacent tubes 40 of a row is selected such that the area of these spacings (i.e., L×D where L is the length of tubes 40 spanning heat exchanger 16B) for each row of tubes is approximately equal to the flow area A of ambient air 100 entering heat exchanger 16B. If necessary, air deflectors can be provided on or incorporated into side walls 16W of heat exchanger 16B to maintain the proper air flow area balance. For example, in the illustrated embodiment, air deflectors 42 are provided at side walls 16W of heat exchanger 16B. Deflectors 42 are sized/shaped to resemble one half of a tube 40. Deflectors 42 can be hollow or solid as none of the refrigerant air is flowed therethrough.

The above-described configuration of triangular tubes 40 forces ambient air 100 to contact the entire surface of the tubes. Accordingly, the efficiency of heat transfer is greatly improved over prior art heat exchangers.

The advantages of the present invention are numerous. Air as a refrigerant is efficiently cooled using Joule-Thomson effect orifices while the novel heat exchanger provides the necessary heat transfer efficiencies that make the air-based air conditioning system a viable alternative to CFC-based air conditioning systems.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. An air conditioning system, comprising:

a compressor for generating compressed air;

an air delivery system coupled to said compressor for receiving said compressed air, said air delivery system including a plurality of Joule-Thomson orifices wherein said compressed air flows through selected ones of said plurality of Joule-Thomson orifices to thereby become refrigerant air; and at least one heat exchanger coupled to said air delivery system for receiving said refrigerant air from said selected ones of said plurality of Joule-Thomson orifices, each said heat exchanger having triangular tubes through which said refrigerant air flows with said triangular tubes being arranged in a spaced-apart relationship to define flow paths therebetween, wherein ambient air moving through said flow paths of each said heat exchanger is cooled.

2. An air conditioning system as in claim 1 wherein said air delivery system includes a control system that controls selection of said selected ones of said plurality of Joule-Thomson orifices.

3. An air conditioning system as in claim 1 wherein said compressor includes means for controlling humidity levels of said compressed air.

4. An air conditioning system as in claim 1 wherein said air delivery system includes a pre-cooler for pre-cooling said compressed air prior to passage through said selected ones of said plurality of Joule-Thomson orifices.

5. An air conditioning system as in claim 1 wherein a cross-sectional shape of each of said triangular tubes is the same.

6. An air conditioning system as in claim 1 wherein a cross-sectional shape of each of said triangular tubes is selected from the group consisting of isosceles and equilateral triangles.

7. An air conditioning system as in claim 6 wherein said means for moving ambient air includes an air outlet coupled to said heat exchanger, said air outlet having an outlet flow area, and wherein said triangular tubes are arranged in rows with each of said rows having a baseline along which bases of said triangular tubes are aligned wherein spaces defined between and adjacent to said triangular tubes along each said baseline define a flow-through area that is approximately equal to said outlet flow area.

8. An air conditioning system as in claim 7 wherein said rows for each said heat exchanger with respect to said air outlet are numbered from n=1 to N, and wherein apexes of said triangular tubes in odd-numbered ones of said rows face said air outlet and apexes of said triangular tubes in even-numbered ones of said rows face away from said air outlet.

9. An air conditioning system as in claim 8 wherein, from n=2 to N, said triangular tubes associated with pairs of adjacent rows interlock one another and are separated from one another by a fixed spacing, and wherein said baseline of each of said odd-numbered ones of said rows is separated by said fixed spacing from said baseline of an adjacent one of said even-numbered ones of said rows.

10. An air conditioning system as in claim 8 further comprising air deflectors adjacent to, aligned with, and spaced apart from each of said odd-numbered ones of said rows.

11. An air conditioning system as in claim 1 further comprising means for forcing the ambient air through said flow paths.

12. An air conditioning system, comprising:

a compressor for generating compressed air;

an air delivery system coupled to said compressor for receiving said compressed air, said air delivery system including a plurality of Joule-Thomson orifices wherein said compressed air flows through selected ones of said plurality of Joule-Thomson orifices to thereby become refrigerant air;

at least one heat exchanger coupled to said air delivery system for receiving said refrigerant air from said selected ones of said plurality of Joule-Thomson orifices, each said heat exchanger having spaced-apart triangular tubes through which said refrigerant air flows and around which flow paths are defined, said triangular tubes of each said heat exchanger being arranged in rows with each of said rows having a baseline along which bases of said triangular tubes are aligned, said rows for each said heat exchanger being numbered from n=1 to N with (i) apexes of said triangular tubes in odd-numbered ones of said rows pointing in a first direction and apexes of said triangular tubes in even-numbered ones of said rows pointing away from said first direction, (ii) from n=2 to N, said triangular tubes associated with pairs of adjacent rows interlocking and separated from one another by a fixed spacing, and (iii) said baseline of each of said odd-numbered ones of said rows being separated by said fixed spacing from said baseline of an adjacent one of said even-numbered ones of said rows; and means for moving ambient air towards said first direction wherein said ambient air moves through said flow paths.

13. An air conditioning system as in claim 12 wherein said air delivery system includes a control system that controls selection of said selected ones of said plurality of Joule-Thomson orifices.

14. An air conditioning system as in claim 12 wherein said compressor includes means for controlling humidity levels of said compressed air.

15. An air conditioning system as in claim 12 wherein said air delivery system includes a pre-cooler for pre-cooling said compressed air prior to passage through said selected ones of said plurality of Joule-Thomson orifices.

16. An air conditioning system as in claim 12 wherein a cross-sectional shape of each of said triangular tubes is the same.

17. An air conditioning system as in claim 12 wherein a cross-sectional shape of each of said triangular tubes is selected from the group consisting of isosceles and equilateral triangles.

18. An air conditioning system as in claim 12 wherein said means for moving ambient air includes an air outlet coupled to said heat exchanger, said air outlet having an outlet flow area, and wherein spaces defined between and adjacent to said triangular tubes along each said baseline define a flow-through area that is approximately equal to said outlet flow area.

19. An air conditioning system as in claim 12 further comprising air deflectors adjacent to, aligned with, and spaced apart from each of said odd-numbered ones of said rows.

20. An air conditioning system, comprising:

a compressor for generating compressed air;

an air delivery system coupled to said compressor for receiving said compressed air, said air delivery system terminating at an exit thereof with a plurality of Joule-Thomson orifices wherein said compressed air flows through selected ones of said plurality of Joule-Thomson orifices to thereby become refrigerant air at said exit;

at least one heat exchanger coupled to said exit for receiving said refrigerant air from said selected ones of said plurality of Joule-Thomson orifices, each said heat exchanger having spaced-apart triangular tubes through which said refrigerant air flows and around which flow paths are defined, each of said triangular tubes having a cross-sectional shape selected from the group consisting of isosceles and equilateral triangles, said triangular tubes of each said heat exchanger being arranged in rows with each of said rows having a baseline along which bases of said triangular tubes are aligned, said rows for each said heat exchanger being numbered from n=1 to N with (i) apexes of said triangular tubes in odd-numbered ones of said rows pointing in a first direction and apexes of said triangular tubes in even-numbered ones of said rows pointing away from said first direction, (ii) from n=2 to N, said triangular tubes associated with pairs of adjacent rows interlocking and separated from one another by a fixed spacing, and (iii) said baseline of each of said odd-numbered ones of said rows being separated by said fixed spacing from said baseline of an adjacent one of said even-numbered ones of said rows; and means for moving ambient air towards said first direction wherein said ambient air moves through said flow paths.

21. An air conditioning system as in claim 20 wherein said air delivery system includes a control system that controls selection of said selected ones of said plurality of Joule-Thomson orifices.

22. An air conditioning system as in claim 20 wherein said compressor includes means for controlling humidity levels of said compressed air.

23. An air conditioning system as in claim 20 wherein said air delivery system includes a pre-cooler for pre-cooling said compressed air prior to passage through said selected ones of said plurality of Joule-Thomson orifices.

24. An air conditioning system as in claim 20 further comprising air deflectors adjacent to, aligned with, and spaced apart from each of said odd-numbered ones of said rows.

* * * * *